United States Patent [19]

Dunlap

[11] 4,024,788

[45] May 24, 1977

[54] MUTE FOR STRINGED INSTRUMENTS

[76] Inventor: Daniel Dunlap, 32 W. 69th St., Apartment 3-A, New York, N.Y. 10023

[22] Filed: Mar. 19, 1976

[21] Appl. No.: 668,453

[52] U.S. Cl. ..... 84/267; 84/290; 84/311; 84/453

[51] Int. Cl.[2] ..... G10D 3/04

[58] Field of Search ..... 84/267, 268, 274, 275, 84/290, 291, 294, 310, 311, 453, 465

[56] References Cited

UNITED STATES PATENTS 2,089,629 8/1937 Stowe ..... 84/294

3,636,809 1/1972 Ezaki ..... 84/453

FOREIGN PATENTS OR APPLICATIONS 448,711 8/1927 Germany ..... 84/310

*Primary Examiner*—Lawrence R. Franklin

*Attorney, Agent, or Firm*—Smith, Harding, Earley & Follmer

[57] ABSTRACT

A mute of soft, flexible sound-absorbing material, located adjacent the exterior of each sound-hole in a stringed instrument to form a substantially complete closure for the same, imparts a new and distinctive sound to the instrument.

9 Claims, 14 Drawing Figures

MUTE FOR STRINGED INSTRUMENTS

BRIEF SUMMARY OF THE INVENTION

This invention relates to mutes for stringed instruments such as violins and guitars, and other similar instruments characterized by a hollow body, a fingerboard attached to the body, a plurality of strings stretched along the fingerboard, and at least one sound-hole in the body providing acoustic communication between the interior and the exterior thereof.

In the case of a violin (which, as used herein, should be understood as including other instruments of the violin family such as violas, cellos, etc.), a typical mute comprises a weighted metal clip adapted to the bridge of the instrument. This type of mute is used in violin practice to reduce the intensity of the emitted sound which would otherwise annoy others in the vicinity. The mute, however, alters the character of the sound produced by the violin, principally by reducing the intensity of the lower-pitched notes to a much greater extent than it reduces the intensity of higher-pitched notes. Because of this alteration of the relationship between the intensities of different notes, the muted instrument does 1 not faithfully reproduce the sound of the unmuted violin. Therefore, especially with advanced students, violin practice using a mute is not as effective as practice without the mute.

A mute is sometimes used in recital or in concert, for special effects. Again, it alters the sound of the instrument, and heretofore, it has been very difficult to reduce the intensity of all the notes in the same proportion.

The principal object of this invention is to provide a new mute which reduces the intensity (measured in dimensions of power/area) of all notes of the instrument more nearly in the same proportion in order to achieve a faithful reproduction of the sound of an unmuted violin for practice purposes, and to produce a new musical sound for recital or concert purposes.

The mute in accordance with the invention comprises a removable member of soft, flexible sound-absorbing material located adjacent the exterior of each sound-hole of the instrument, and forming a substantially complete closure for the same, and resilient means secured to said member, extending into the sound-hole closed by said member, said resilient means bearing against the periphery of the sound-hole into which it extends and thereby holding said member in position. Preferably, the removable member extends laterally beyond the periphery of the sound-hole adjacent which it is located, at least to an extent sufficient to prevent the removable member from falling into the interior of the hollow body of the instrument. The soft, flexible sound-absorbing material is preferably a foam plastic.

Further objects and other details of the construction and use of the mute in accordance with the invention will appear in the following detailed description, when read in conjunction with the drawings.

DETAILED DESCRIPTION

Referring to FIGS. 1 through 4, the preferred violin mute 16 in accordance with the invention consists of a unitary member of soft, flexible, sound-absorbing material such as foam plastic. Flexible foam polyethylene, flexible urethane foam, and foam rubber are among the many foam plastics suitable for use.

Figure 1:
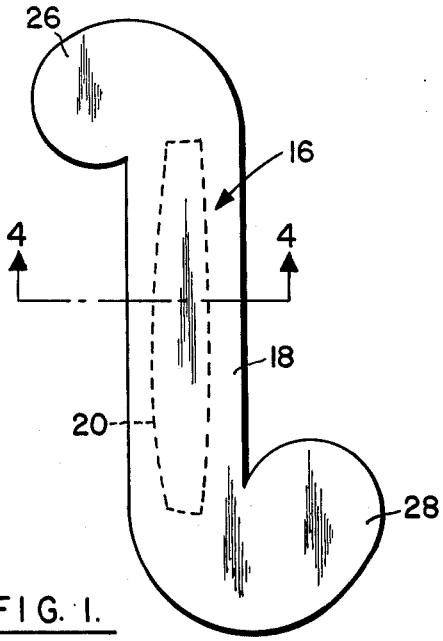
FIG. 1 is a top plan view of a first violin mute in accordance with the invention.
Figure 4:
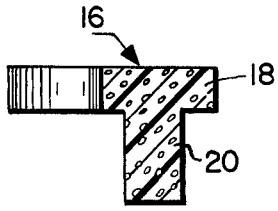
FIG. 4 is a vertical section taken on the plane 4—4 of FIG. 1.
Figure 3:
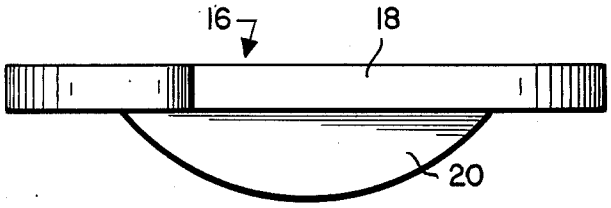
FIG. 3 is a right-hand side elevation of the mute of FIG. 1.
Figure 2:
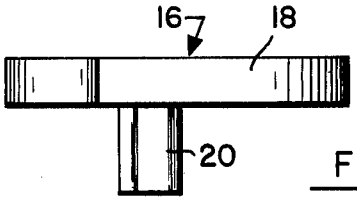
FIG. 2 is an elevational view of the mute of FIG. 1, as viewed from the bottom of FIG. 1.

The mute 16 of FIG. 1 is preferably molded as a unit. The mute consists of a first member 18, the shape of which is similar to the F-hole of a violin, except that it is larger than an F-hole so that it extends laterally beyond the periphery of the F-hole adjacent which it is located at least to an extent sufficient to prevent it from falling into the interior of the hollow body of the violin. Extending downwardly from member 18 is a second member 20, which is integral with, or otherwise secured to member 18. Member 20 is adapted to extend into the F-hole of a violin, and its width is slightly greater than the distance between the opposing, elongated sides of the F-hole. Member 20 is resilient, and bears against the opposing, elongated sides of the F-hole, thereby holding member 16 in position. The aforementioned foam plastics have sufficient resilience to meet the requirements of member 20. Consequently, it is possible for member 16 to be molded as a unit from a single material.

Figure 5:
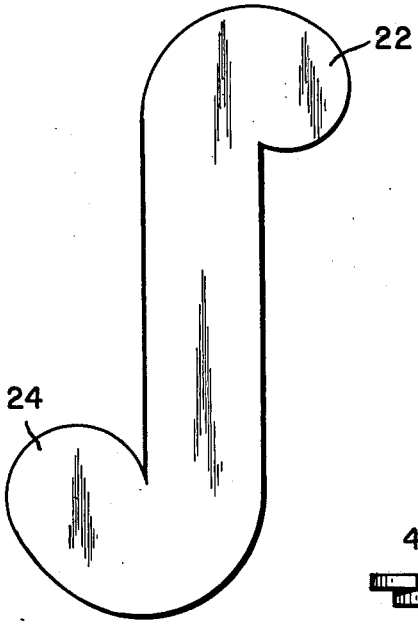
FIG. 5 is a top plan view of a mute similar to the mute of FIG. 1, but adapted to close the F-hole of a violin, opposite the one closed by the mute of FIG. 1.

The mute of FIG. 5 is similar to the mute of FIG. 1, except that its bulbous end portions 22 and 24 extend in directions opposite to the directions of the corresponding bulbous end portions 26 and 28 of mute 16. The mutes of FIGS. 1 and 5 are used in pairs, each fitting in the F-hole of a violin having the corresponding configuration.

Figure 6:
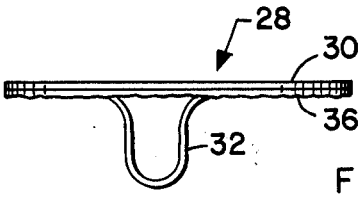
FIG. 6 is an elevational view of an alternative mute for a violin.
Figure 7:
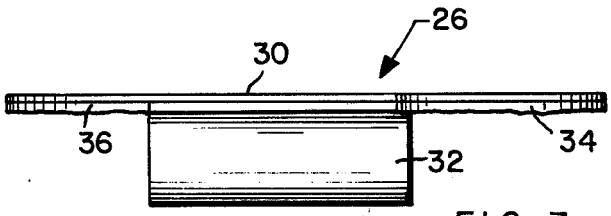
FIG. 7 is a side elevation of the alternative mute of FIG. 6.

FIGS. 6 and 7 illustrate an alternative violin mute 28, the top 30 of which comprises a sheet of rubber or similar flexible material to which is secured a downwardly extending loop 32 of sheet rubber. Loop 32 is glued to sheet 30, and is shaped so that it bears against the periphery of the F-hole into which it extends by virtue of its resilience. The sheet of rubber forming top 30 is soft, flexible and sound-absorbing. However, for improved sound absorbtion, there are glued to the underside of top 30 two separate sheets 34 and 36 of cloth or felt, these sheets being located underneath the bulbous ends of top 30 at the opposite ends of rubber loop 32.

Figure 8:
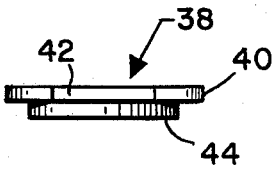
FIG. 8 is an elevational view of a guitar mute in accordance with the invention.
Figure 9:
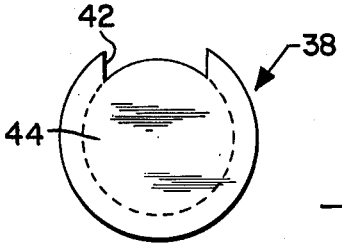
FIG. 9 is a bottom plan view of the mute of FIG. 8.

FIGS. 8 and 9 show a guitar mute 38 comprising a unitary molded member of soft, flexible sound-absorbing material such as foam plastic. The mute consists of an upper part 40, generally circular in shape, but with a cut-out portion 42 adapted to receive the end of a guitar fingerboard, and a downwardly extending resilient member 44 adapted, by virtue of its own resilience, to bear against the periphery of the guitar's sound-hole.

Figure 10:
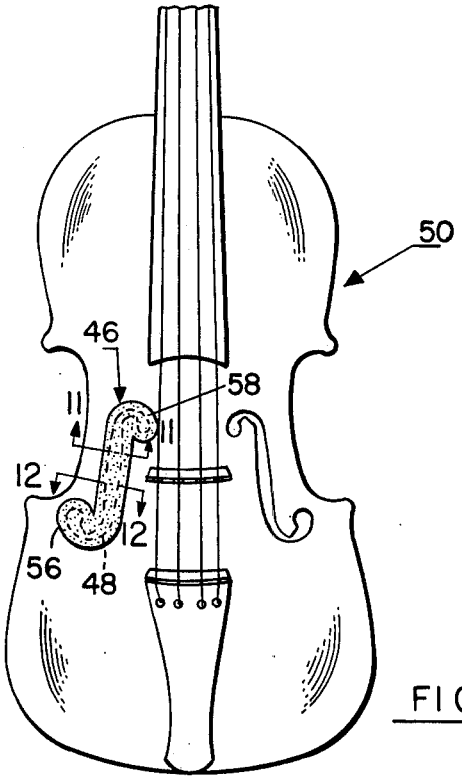
FIG. 10 is a top plan view of a violin, one of the F-holes of which is closed by a mute in accordance with the invention.
Figure 11:
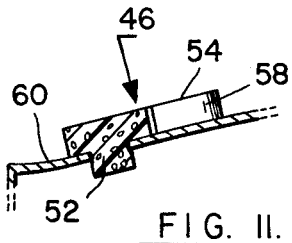
FIG. 11 is a vertical section taken on the plane 11—11 of FIG. 10.
Figure 12:
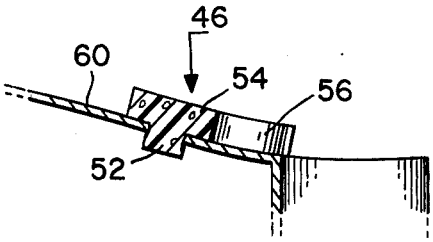
FIG. 12 is a vertical section taken on the plane 12—12 of FIG. 10.

FIGS. 10, 11 and 12 illustrate the relationship of a foam plastic mute 46 to one of the F-holes 48 in a violin 50. As shown, the resilient downwardly extending portion 52 of the mute extends into the F-hole, and holds the upper member 54 of the mute in a position such that it forms a substantially complete closure for the F-hole. It is important that the upper part 54 of the mute be flexible, so that its bulbous ends 56 and 58 can conform to the curved top 60 of the violin body to insure a substantially complete closure of the F-hole. As shown in FIG. 10, the mute overlaps substantially the entire periphery of the F-hole.

Figure 13:
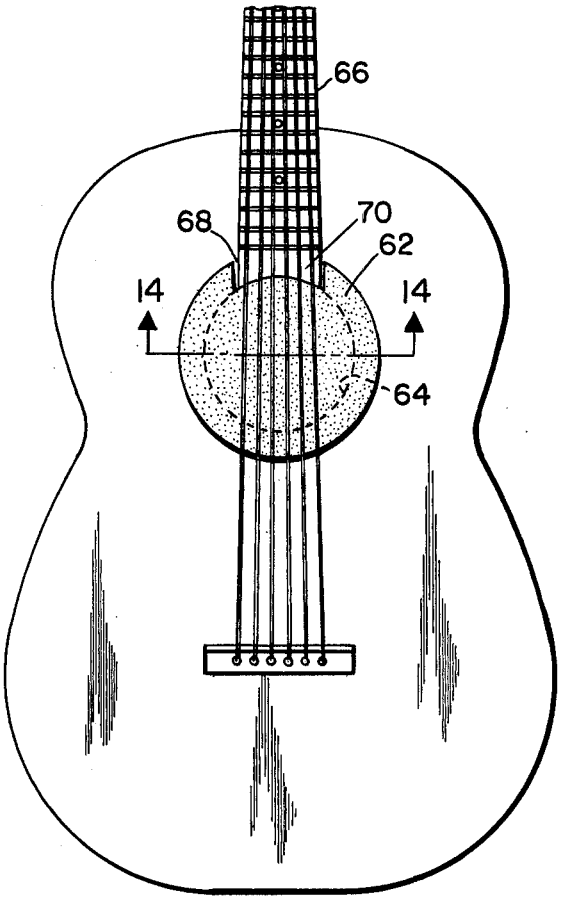
FIG. 13 is a top plan view of a guitar provided with a mute in accordance with the invention.
Figure 14:
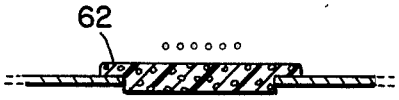
FIG. 14 is a vertical section taken on the plane 14—14 of FIG. 13.

FIGS. 13 and 14 illustrate the manner in which a guitar mute 62 is installed in the sound-hole 64 of a guitar. As seen in FIG. 13, the fingerboard 66 of the guitar terminates at the location of the periphery of the sound-hole. The cut-out portion 68 of the mute is adapted to receive end 70 of the fingerboard. The upper part of the mute extends laterally beyond the periphery of the sound-hole throughout substantially the entire circumference of the sound-hole except for the part of said circumference adjacent the terminating end 70 of the fingerboard. In this way, the mute forms a substantially complete closure for the sound-hole of the guitar, which is important for effective muting.

I claim:

1. In a musical instrument having a hollow body, a fingerboard attached to said body, a plurality of strings stretched along said fingerboard, and at least one sound hole in said body providing acoustic communication between the interior and the exterior thereof, the improvement comprising:

a removable member of soft, flexible, sound-absorbing material located adjacent the exterior of each sound hole and forming a substantially complete closure for the same, and resilient means secured to said member, extending into the sound hole closed by said member said resilient means bearing against the periphery of the sound hole into which it extends and thereby holding said member in position.

2. The combination according to claim 1 in which said removable member extends laterally beyond the periphery of the sound hole adjacent which it is located, at least to an extent sufficient to prevent said removable member from falling into the interior of said hollow body.

3. The combination according to claim 1 in which the soft, flexible, sound-absorbing material is a foam plastic.

4. The combination according to claim 1 in which said musical instrument is a guitar.

5. The combination according to claim 1 in which said musical instrument is a guitar and said sound hole is a single, substantially circular opening, the fingerboard extending along the outside of said body and terminating at the location of the periphery of the sound hole, and said removable member extending laterally beyond the periphery of the sound hole at least throughout substantially the entire circumference of said sound hole except for the part of said circumference adjacent the termination of the fingerboard, and said removable member being substantially circular in shape and having a cut-out portion adapted to receive the end of said fingerboard.

6. The combination according to claim 1 in which said musical instrument is a violin.

7. The combination according to claim 1 in which said musical instrument is a violin, each sound hole is an f-shaped opening in said body, and the removable member adjacent the exterior of each sound hole overlaps substantially the entire periphery of its sound hole.

8. The combination according to claim 1 in which said musical instrument is a violin, each sound hole is an f-shaped opening in said body, and the removable member adjacent each sound hole is an f-shaped member the ends of which conform in direction to the ends of adjacent f-shaped opening, each removable member overlapping substantially the entire periphery of its sound hole.

9. The combination according to claim 8 in which the soft, flexible sound-absorbing material is a foam plastic.

* * * * *